US010254044B2

(12) United States Patent
Schindler et al.

(10) Patent No.: US 10,254,044 B2
(45) Date of Patent: Apr. 9, 2019

(54) METHOD AND DEVICE FOR EXTRACTING, HEATING, AND RECIRCULATING WASTE AIR FROM A DRYER SYSTEM

(71) Applicants: Sabine Schindler, Niederkrüchten (DE); Norbert Heckmann, Schwalmtal (DE)

(72) Inventors: Sabine Schindler, Niederkrüchten (DE); Norbert Heckmann, Schwalmtal (DE)

( * ) Notice: Subject to any disclaimer, the term of this patent is extended or adjusted under 35 U.S.C. 154(b) by 492 days.

(21) Appl. No.: 14/671,119

(22) Filed: Mar. 27, 2015

(65) Prior Publication Data

US 2015/0276315 A1 Oct. 1, 2015

(30) Foreign Application Priority Data

Mar. 28, 2014 (EP) ..... 14162383

(51) Int. Cl.
*F26B 23/00* (2006.01)
*F26B 21/04* (2006.01)
*F26B 23/02* (2006.01)

(52) U.S. Cl.
CPC ..... *F26B 23/002* (2013.01); *F26B 21/04* (2013.01); *F26B 23/022* (2013.01); *F26B 2210/12* (2013.01)

(58) Field of Classification Search
CPC ..... F26B 23/00; F26B 23/001; F26B 23/022; F26B 23/024; F26B 23/002; F26B 21/04; F26B 21/006; F26B 21/00; F26B 2210/12
USPC ... 34/86, 218, 219, 270, 271, 272, 467, 513, 34/514, 666; 165/901; 432/72
See application file for complete search history.

(56) References Cited

U.S. PATENT DOCUMENTS

| | | | |
|---|---|---|---|
| 9,228,781 | B2 | 1/2016 | Weschke et al. |
| 2013/0014406 | A1 | 1/2013 | Weschke et al. |

FOREIGN PATENT DOCUMENTS

| | | | |
|---|---|---|---|
| CN | 1464965 | A | 12/2003 |
| CN | 1233975 | C | 12/2005 |
| CN | 101970965 | A | 2/2011 |
| CN | 203061402 | U | 7/2013 |
| DE | 19735322 | | 2/1999 |
| DE | 19735322 | A1 | 2/1999 |
| DE | 102010001234 | | 7/2011 |
| EP | 2295909 | | 3/2011 |

*Primary Examiner* — Jessica Yuen
(74) *Attorney, Agent, or Firm* — Muncy, Geissler, Olds & Lowe, P.C.

(57) ABSTRACT

A method for efficient utilization of hot air flows in a dryer system for goods to be dried is provided, in particular for a vehicle painting plant. Waste air from the dryer is heated in a thermal post-combustion plant and, as clean gas is conducted through circulating air recuperators, the circulating air extracted from the dryer is heated up and returned into the dryer. A device for efficient utilization of the hot air flows in a dryer system for goods to be dried is also provided, in particular for a vehicle painting system. The device includes a dryer, the waste air of which is heated in a thermal post-combustion plant. Clean gas is fed to circulating air recuperators and at least one fresh air recuperator. At least one additional heat source for the clean gas is also provided.

5 Claims, 1 Drawing Sheet

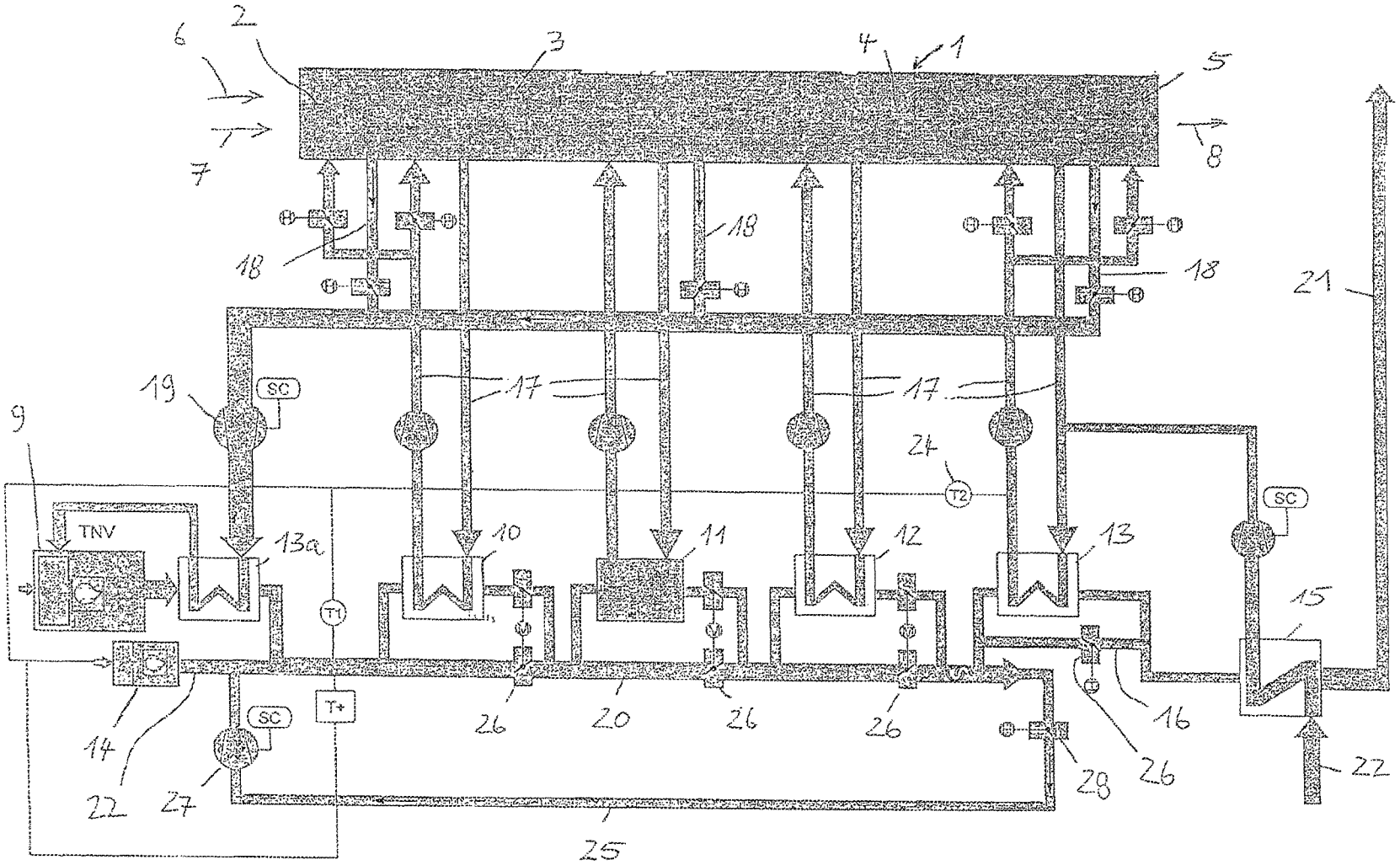
SC
SC
SC
TNV
T2
T1
T
1
2
3
4
5
6
7
8
9
10
11
12
13
13a
14
15
16
17
18
19
20
21
22
24
25
26
27
28

METHOD AND DEVICE FOR EXTRACTING, HEATING, AND RECIRCULATING WASTE AIR FROM A DRYER SYSTEM

BACKGROUND OF THE INVENTION

Field of the Invention

The invention relates to a method for the efficient utilisation of the hot air flows in a dryer system for goods to be dried, in particular for a vehicle painting plant, in which the waste air from the dryer is heated in a thermal post-combustion system and as clean gas is conducted as through circulating air recuperators, in which the circulating air extracted from the dryer is heated up and returned into the dryer.

Brief Discussion of the Related Art

In dyers for paint shops, in particular vehicle paint shops, the freshly painted goods to be dried according to the prior art, for example bodies, are mostly moved into the dryer on a support frame (SKID), the organic solvents being present in the fresh paint of the goods to be dried. Following the heating-up in the heating-up zone of the dryer, bodies for example enter the holding zone of the dryer at approximately 140° C.-180° C. Following this, the bodies leave the dryer.

The gaseous, organic substances liberated during the drying process are suctioned and fed as waste air (raw gas) to a thermal post-combustion system (TNV) for the oxidative conversion of the organic substances into the non-toxic compounds carbon dioxide and steam. Before entering the thermal post-combustion system, the waste air is regularly pre-heated in a waste air recuperator. The clean gas from the post-combustion plant initially cools down in the waste air recuperator and is subsequently utilised for heating the dryer.

This takes place in the manner that the clean gas is conducted further through circulating air recuperators which reheat the circulating air extracted from the dryer, following which the circulating air is again returned into the dryer. Finally, the clean gas can still be conducted through a fresh air recuperator in order to heat up the fresh air to be fed to the dryer.

This known drying process is no longer efficient enough because of the rising primary energy prices. The process heat requirement for the dryer and the real primary energy consumption are not balanced since the projected clean gas temperature of 160° C.-180° C. does not correspond to the real clean gas temperature. Experience has shown that the clean gas temperatures are mostly between 280° C.-320° C.

The aim therefore is to operate the thermal post-combustion system not at full load but at part load.

SUMMARY OF THE INVENTION

The invention is based on the object of creating a more efficient method for energy saving in drying plants. In addition, a device for carrying out the method is to be additionally shown.

In terms of the process the object according to the invention is solved in that the clean gas is subjected to at least one additional heat source.

With the additional heat source, the clean gas can be additionally heated. Because of this it is now nevertheless possible to reduce the actual thermal post-combustion. The rating is the adequate oxidative conversion of the substances at full load operation.

With the additional heat source, control of the temperatures of the conducted gas flows can take place. Control via volumetric flow rates is no longer necessary. The volumetric flow rates can rather be set at a constant rate while it is also possible to accelerate volumetric flow rates. The same amount of heat can be transported with a larger volumetric flow rate and a temperature that is lower by contrast.

Controlling the temperature is simpler than controlling volumetric flow rates. The additional heat source can be controlled out of the process so that it inputs only so much additional heat energy as is needed for the process.

According to a further development of the invention it is provided that clean gas is extracted from a region upstream of the last circulating air recuperator and returned into the region of the additional heat source. Normally, the clean gas conducted through the clean gas line is completely discharged via a stack having passed the recuperators. A fixed volumetric flow rate is steadily run via the stack and a fixed volumetric flow rate as circulating air. The rating via the stack=waste air via TNV is the adequate oxidative conversion of the substances at full load=maximum throughput. The lower waste air volumetric flow rate is amended by the circulating air component, equal to an increase of the clean gas volumetric flow rate in the region of the circulating air recuperators. Thus, the heat contained in the clean gas is retained in the system and the efficiency of the drying system is further increased. The addition heat source makes available only so much heat energy as is required.

According to a further development of the invention it is provided that the operation of the additional heat source is controlled with the help of the temperature conditions in the last circulating air recuperator. The last circulating air recuperator is subjected to the clean gas blast. When it is determined that the temperature in this last circulating air recuperator drops below a fixed value, the additional heat source is put into operation since it is controlled by means of the temperature conditions in this circulating air recuperator circuit.

The solution of the object on the device side, for which independent protection is claimed, is characterized in that at least one additional heat source is provided.

The clean gas can be additionally subjected to this additional heat source according to methods according to the invention. The additional heat source is preferentially an additional burner that can be operated with the same fuel as the thermal post-combustion. The additional burner is assigned to the clean gas line so that it can act on the clean gas before the same reaches the first circulating air recuperator.

According to a further development of the invention, a circulating air system is provided. This has at least one return line that is parallel to the clean gas line, wherein the return line and clean gas line are linked via connections in the region of the additional heat source and upstream of the last circulating air recuperator. Clean gas can be branched off from the clean gas line upstream of the last circulating air recuperator and conducted into the region of the additional heat source via the return line. To this end, a fan is preferentially contained in the return line, in particular for resetting and maintenance purposes the return line can also be closed off by a closure element.

Finally, a closable bypass line is assigned to the last circulating air recuperator.

BRIEF DESCRIPTION OF THE DRAWINGS

The sole drawing schematically illustrates an exemplary embodiment of the method according to the invention and of the device according to the invention.

DETAILED DESCRIPTION OF THE PREFERRED EMBODIMENTS

The dryer 1 has an entry lock 2, a heating-up zone 3, a holding zone 4 and an exit lock 5. The arrow 6 symbolises the introduction of the goods to be dried, for example bodies, which are situated on SKIDs. The arrow 7 symbolises the input of the solvents which are introduced in the dryer with the paint coatings of the goods to be dried. The arrow 8 symbolises the dried goods leaving the dryer and SKIDs. The thermal post-combustion plant TNV is marked with 9. 10 to 13 are circulating air recuperators. 13*a* is a waste air recuperator and 15 is a fresh air recuperator. 21 marks a waste air stack. The arrows 22 designate the feeding of fresh air from the environment. The waste air lines are marked with 18 and the circulating air lines are marked with 17.

The waste air (raw gas) extracted from the dryer 1 via the waste air lines 18 is fed to the TNV 9 via a fan unit 19 and the waste air recuperator 13*a*, where it is subjected to the oxidation process. The waste air purified through the conversion leaves the TNV 9 as clean gas in the clean gas line 20. The clean gas is initially conducted through the waste air recuperator 13*a*, then through the circulating air recuperators 10 to 13 and finally flows through the fresh air recuperator 15, following which it exits into the atmosphere via the waste air stack 21.

Flaps 26 are inserted in the clean gas line 20. These correspond to flaps in diversions 27 of the clean gas line 20. In the diversion 27, a circulating air recuperator 10 to 13 each is inserted, the last circulating air recuperator 13 being assigned a bypass line 16 with a corresponding flap 26.

The flaps 26 establish a controlled through-flow of the clean gas and circulating air through the circulating air recuperators 10 to 13. Circulating air and the clean gas are no longer controlled, rather the temperature of the clean gas and circulating air is controlled. The addition burner 14, which acts on the clean gas line 20 via a line section 22 serves for this purpose. The additional burner 14 is operated via a control line, which is linked to a temperature sensor 24 in the last circulating air recuperator circuit.

The clean gas line 20 is connected to a return line 25 before entering the last circulating air recuperator 13. The return line 25 leads back into the region of the original burner 14, where it is linked to the line section 22. A fan 27 and a closure flap 28 are inserted in the return line 25.

Further fans are additionally inserted in the circulating air lines 17 and the fresh air line.

The invention claimed is:

1. A device for the efficient utilization of hot air flows in a dryer system for goods to be dried, comprising:

a dryer, the waste air of which is heated in a thermal post-combustion plant and can be returned as clean gas to circulating air recuperators and at least one fresh air recuperator;

at least one additional heat source for the clean gas; and an air recirculating system comprising:

a clean gas line; and at least one return line, which is guided parallel to the clean gas line;

wherein a last circulating air recuperator is disposed at a first end of the clean gas line and the at least one additional heat source is disposed at a second end of the clean gas line the second end being opposite to the first end, and wherein the return gas line is connected to the clean gas line directly before the at least one additional heat source and after the connection of the last circulating air recuperator.

2. The device according to claim 1, wherein the additional heat source is an additional burner.

3. The device according to claim 1, wherein the additional heat source is assigned to the clean gas line upstream of the first circulating air recuperator.

4. The device according to claim 1, wherein at least one fan is arranged in the return line.

5. The device according to claim 1, wherein at least one closure element for the media conducted through the return line is arranged in the return line.

* * * * *